US005821680A

United States Patent [19]

Sullivan et al.

[11] Patent Number: 5,821,680

[45] Date of Patent: Oct. 13, 1998

[54] MULTI-LAYER CARBON-BASED COATINGS FOR FIELD EMISSION

[75] Inventors: John P. Sullivan; Thomas A. Friedmann, both of Albuquerque, N. Mex.

[73] Assignee: Sandia Corporation, Albuquerque, N. Mex.

[21] Appl. No.: 731,651

[22] Filed: Oct. 17, 1996

[51] Int. Cl.[6] ..... H01J 19/24

[52] U.S. Cl. ..... 313/310; 313/309

[58] Field of Search ..... 313/495, 496, 313/497, 309, 310, 336, 351; 315/169.4

[56] References Cited

U.S. PATENT DOCUMENTS

| | | | |
|---|---|---|---|
| 5,180,951 | 1/1993 | Dworsky et al. | 315/169.4 |
| 5,194,780 | 3/1993 | Meyer et al. | 315/169 |
| 5,341,063 | 8/1994 | Kumar | 313/309 |
| 5,411,772 | 5/1995 | Cheung et al. | 427/586 |
| 5,439,753 | 8/1995 | Rogers et al. | 428/688 |
| 5,449,970 | 9/1995 | Kumar et al. | 313/309 |
| 5,463,271 | 10/1995 | Geis et al. | 313/310 |
| 5,502,347 | 3/1996 | Dworsky et al. | 313/309 |
| 5,536,193 | 7/1996 | Kumar et al. | 445/24 |
| 5,602,439 | 2/1997 | Valone | 313/310 |

OTHER PUBLICATIONS

Geis et al., "Diamond Cold Cathode," IEEE Electron Device Letters, vol. 12, No. 8, pp. 456–459, Aug. 1991.

K. Okano et al., "Synthesis of A–Type Semiconducting Diamond FILM Using Diphosphorous Pentaxide as the Doping Source," Applied Physics A vol. 51 pp. 1731–1733, 1991 (No Month).

Geis, "Growth of Device Quality Homoepitaxial Diamond Thin FILMS," Diamond Silicon Carbide and Related Wide Bandgap Semiconductors, Materials Research Soc. pp. 15–22, 1990 (No Month).

J. Prins, "Bipolar Transistor Action in Ion Implanted Diamond," Applied Physics Letter, vol. 41 pp. 950–952, Nov. 1982.

R. P. H. Chang; AT&T Bell Laboratories, Murray Hill, New Jersey and B. Abeles; Exxon Research and Engineering Co., Annandale, New Jersey, Plasma Synthesis and Etching of Electronic Materials, Materials Research Society Symposia Proceedings, vol. 38., held Nov. 27–30, 1984, Boston, Massachusetts.

S. S. Wagal, E. M. Juengerman, and C. B. Collins, Diamond–Like Carbon Films Prepared with a Laser Ion Source, Appl. Phys. Lett. 53(3), 18 Jul. 1988, pp. 187–188.

Adrianus J. Dekker, Free Electron Theory of Metals, *Solid State Physics,* Prentice–Hall, Inc., 1957, p. 227, (No Month).

Joseph D. Shovlin and Martin E. Kordesch, Electron Emission from Chemical Vapor Deposited Diamond and Dielectric Breakdown, Appl. Phys. Lett. 65(7), 15 Aug. 1994, pp. 863–865.

*Primary Examiner*—Sandra L. O'Shea
*Assistant Examiner*—Michael Day
*Attorney, Agent, or Firm*—Timothy P. Evans

[57] ABSTRACT

A multi-layer resistive carbon film field emitter device for cold cathode field emission applications. The multi-layered film of the present invention consists of at least two layers of a conductive carbon material, preferably amorphous-tetrahedrally coordinated carbon, where the resistivities of adjacent layers differ. For electron emission from the surface, the preferred structure can be a top layer having a lower resistivity than the bottom layer. For edge emitting structures, the preferred structure of the film can be a plurality of carbon layers, where adjacent layers have different resistivities. Through selection of deposition conditions, including the energy of the depositing carbon species, the presence or absence of certain elements such as H, N, inert gases or boron, carbon layers having desired resistivities can be produced.

14 Claims, 4 Drawing Sheets

MULTI-LAYER CARBON-BASED COATINGS FOR FIELD EMISSION

STATEMENT OF GOVERNMENT INTEREST

This invention was made with Government support under contract no. DE-AC04-94AL85000 awarded by the U.S. Department of Energy to Sandia Corporation. The Government has certain rights in the invention.

BACKGROUND OF THE INVENTION

This invention pertains generally to cold cathode field emission and particularly to a multi-layer carbon-based field emitter device.

Field emitter materials are useful whenever a source of electrons is needed, in particular, for applications such as vacuum microelectronics, electron microscopy and flat panel displays. Flat panel displays that use field emission (cold cathode emission) have several potential advantages over other types of flat panel displays including; low power consumption, high intensity or brightness, large viewing angle, low projected cost, and robustness. For these reasons, field emission displays have the potential to be a low cost, high performance alternative to cathode ray and liquid crystal display technologies. One of the key issues in producing commercially viable field emitters is the development of reliable and efficient field emitter (cold cathode) materials for these devices. At the present time, field emitter materials typically require either complicated fabrication steps or high control voltages to promote emission or both. Furthermore, currently available field emitter materials have several limitations which restrict their usefulness including the lack of uniformity of emission current over the surface of the field emitter material and dynamic changes in emission with time (twinkling). It is believed that the reasons for these limitations include non-uniform current conduction through the field emitter material and the build-up of local fields due to charge separation resulting from steady-state (DC) emission.

In resistive materials at high fields current conduction can occur along filamentary conduction paths and this can lead to emission nonuniformity (e.g., the creation of discrete emission sites). During steady-state emission a space charge region can build up around these filamentary paths leading to an opposing electric field being generated. When this occurs, a greater applied field is required to maintain electron emission or the emission site will cease to emit electrons. On the other hand, a neighboring emission site in the field emitter material which was formerly inactive may "turn on" once its neighbor is "turned off". It is this progressive "turning off" and "turning on" of electron emission sites that leads to "twinkling". Thus, as more and more emission sites are "turned off" due to the build up of space charge layers, a higher voltage is required to promote electron emission.

It is known in the art to use various homogeneous materials or films for cold cathode emission applications. Included are such materials as crystalline diamond; amorphous carbon films or silicon; and patterned bulk materials, such as silicon or molybdenum "Spindt" tips. Also included are surface adsorbed or deposited layers, such as cesium or gold layers deposited on a material such as diamond or carbon to improve electron emission properties, or surface etching such as ion beam etching of diamond. However, these prior art materials or processes are either expensive to produce over the large areas necessary for field emission applications (patterned bulk material) or display undesirable properties such as high turn-on voltage, or non-uniform spatial or temporal emission characteristics, as set forth hereinabove.

One promising class of field emitter materials is amorphous carbon films containing at least some fraction of tetrahedrally-coordinated (4-fold coordinated) carbon atoms, hereinafter referred to as amorphous-tetrahedral coordinated carbon (or a-tC carbon). Such films have been shown to be excellent field emitters requiring only low turn-on voltages. However, these a-tC films can exhibit many of the aforementioned undesirable properties of other field emitter materials (e.g., localized emission sites, twinkling, etc.).

What is needed is a field emitter device that is inexpensive, easy to produce, has a low turn-on voltage and is stable in time and wherein electron emission is uniform across the field emitter device and the density of electron emission sites is increased.

Responsive to these needs, the present invention provides a field emitter device having an improved uniformity of electron emission, a high density of electron emission sites, a low turn-on voltage, is inexpensive to produce, does not require photolithographic patterning processes, and can be readily formed over large areas and a method for creating these materials.

SUMMARY OF THE INVENTION

The present invention is directed to a novel field emitter device for cold cathode field emission applications, comprising a multi-layer resistive carbon film, and methods for preparing the same.

The structure of the novel field emitter device of the present invention comprises a resistive carbon film, disposed on a substrate surface, having a layered structure that can include at least two layers possessing differing resistivities. The layered structure can be comprised of carbon or a carbon-based material, preferably a carbon-based alloy and most preferably a-tC carbon, and can be formed by depositing, preferably by pulsed laser deposition PLD or filtered arc deposition, a layer of carbon or a carbon-based material, having a resistivity $\rho_1$, onto a layer of carbon or a carbon-based material having a resistivity $\rho_2$, wherein $\rho_1 \neq \rho_2$. A film having a plurality of layers of carbon having unequal resistivities in alternate layers can also be prepared by the method of the present invention. It will be appreciated that electron emission from this layered carbon structure can occur from either the surface of the field emitter device or from an edge. The simplest preferred structure for electron emission from the surface of the device of the present invention, comprises a film consisting of two layers, disposed on a substrate, wherein the topmost film has a resistivity less than that of the underlying film.

The inventors have discovered that it is possible to vary the resistivity of the layers in the carbon film by changing the energies of the carbon species that form the layers. That is, the higher the energy (below about 100 eV/ion) of the carbon species the higher the resistivity of the carbon layer produced, and conversely. By way of example, in the case where PLD is used to produce a carbon layer, the higher the fluence (energy density) of a laser impinging on a graphite target, the source of carbon, the higher the resistivity of the carbon layer formed. Similar effects can be achieved by accelerating or decelerating carbon species produced by the process of filtered arc deposition, thereby controlling the resistivities of the carbon layers produced. Another approach that can be used to provide carbon layers of varying resistivity is to intentionally backfill a deposition chamber with an inert background gas such as Ar or Ne to a pressure in the range of a few mTorr. The inert background gas permits collisional cooling of the carbon species, thereby reducing the resistivity of the carbon layer.

Additional modifications to the resistivity of carbon layers can be achieved by exploiting the metastability of the 4-fold coordinated carbon bond that can be formed in a-tC. The metastable 4-fold carbon bond can be reduced to a 3-fold carbon bond, thereby offering the potential for electrical conductivity, by the application of energy. Thus, exposing carbon layers to an ion or intense electron beam irradiation, where the ions can be from an inert gas such as Ar or Ne or a chemically reactive gas such as $N_2$ or $H_2$, can produce carbon layers of lowered resistivity. Supplying a heat pulse (heating to at least 100° C.) during deposition can reduce the resistivity of the carbon layer.

Chemical additions to carbon layer can modify its resistivity. Incorporation of hydrogen or nitrogen, by depositing a carbon layer in an atmosphere of $H_2$ or $N_2$ or the implantation of H or N into the layer, changes the bonding within the layer, thereby reducing the resistivity of the layer. Incorporation of metals into the carbon layer can also change carbon layer resistivities.

BRIEF DESCRIPTION OF THE DRAWINGS

The accompanying drawings, which are incorporated in and form part of the specification, illustrate the present invention and, together with the description, explain the invention. In the drawings like elements are referred to by like numbers.

a) undoped b) doped with $N_2$

Figure 4A:
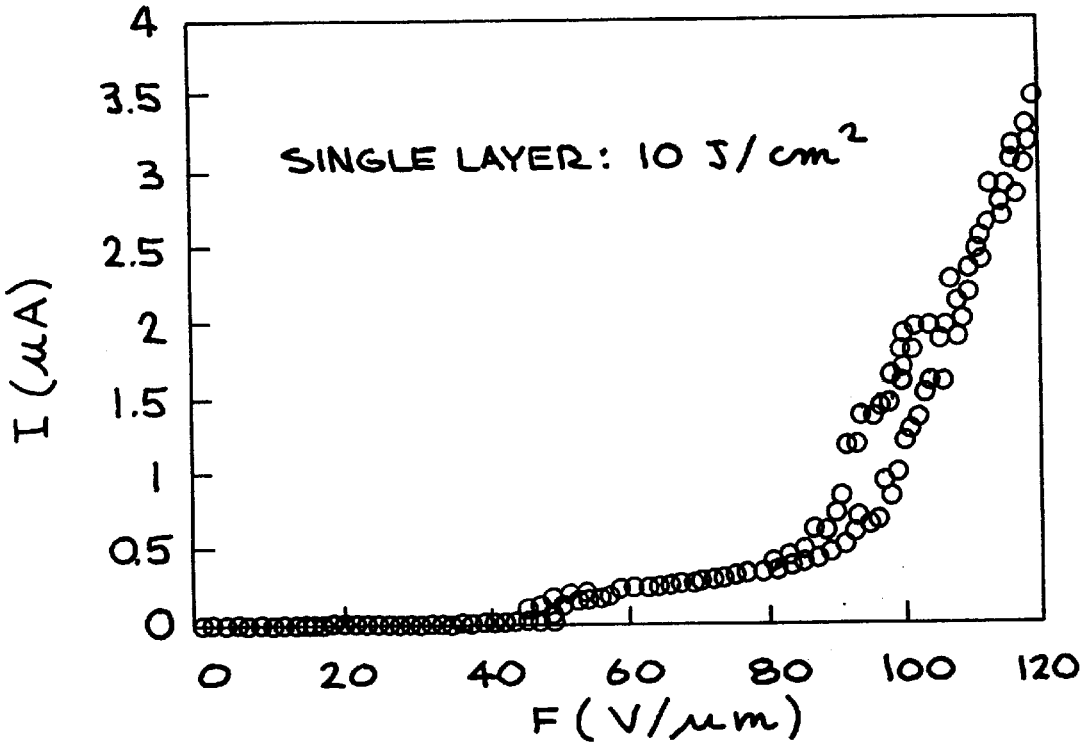
Figure 4B:
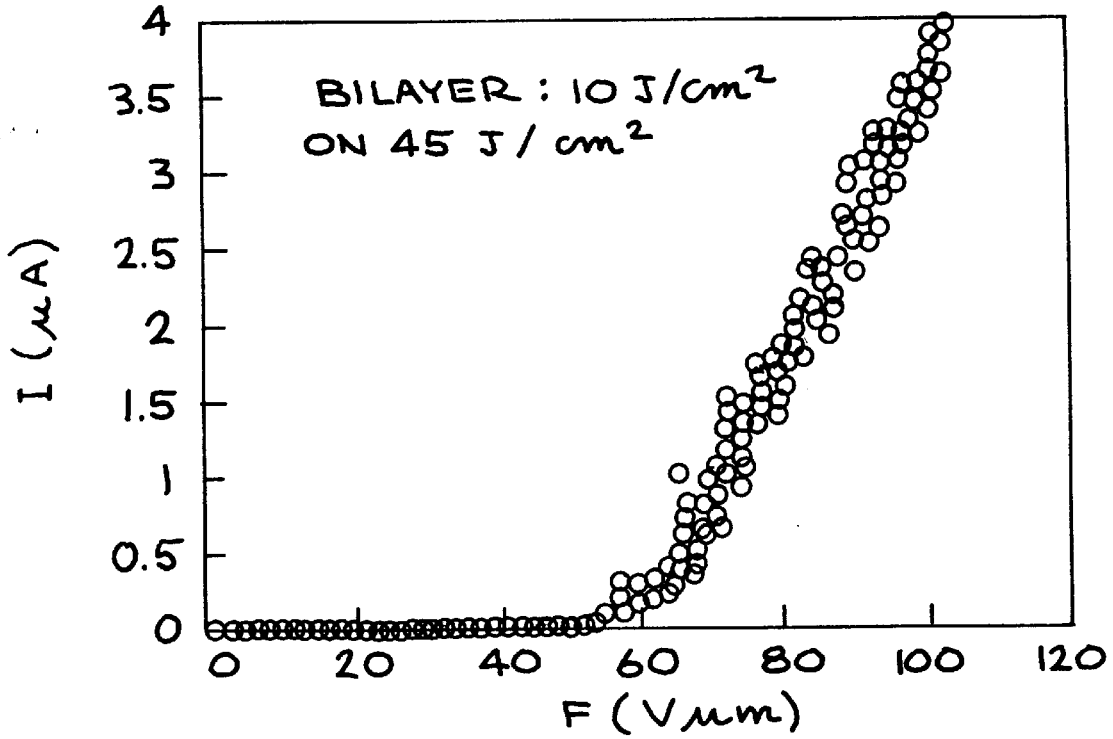

FIGS. 4(*a*) and 4(*b*) compare electron emission from a) a single layer carbon film b) a bilayer carbon film.

Figure 5A:
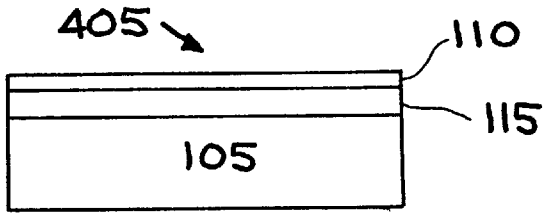
Figure 5B:
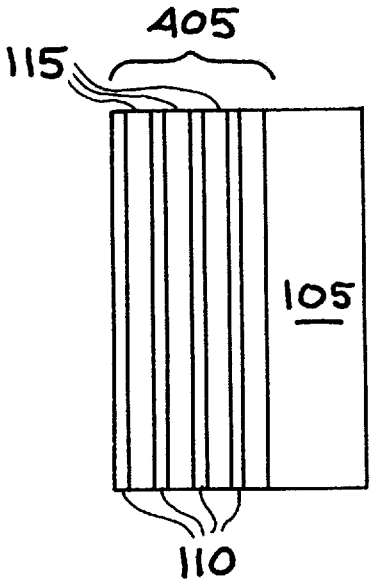

FIGS. 5(*a*) and 5(*b*) show two embodiments of the present invention a) emission from the surface b) emission from the edge.

DETAILED DESCRIPTION OF THE INVENTION

The present invention is directed to a novel field emitter device, comprising an internally structured film for cold cathode field emission applications, wherein the film has superior properties in comparison with conventional field emitter materials, and wherein the film can be a multi-layer carbon-based field emitter material.

To better appreciate the present invention, the following introductory comments are provided. Electron emission from a material occurs whenever electrons are able to either cross a potential energy barrier or tunnel through it, in accordance with the probabilities of quantum mechanics. The requisite energy for crossing the potential energy barrier can be supplied by several means. Thermionic or photoelectric electron emission can occur whenever sufficient energy in the form of electromagnetic radiation, longer wavelengths (heat) in the case of thermionic electron emission and shorter wavelengths (light) in the case of photoelectron emission, is provided to electrons to permit them to be spontaneously emitted. Secondary emission of electrons can occur, for example, by bombardment of a substance with charged particles such as electrons or ions. Field emission or cold cathode emission occurs under the influence of a strong electric field.

The theory of field emission is well developed; see, for example, A. J. Dekker, *Solid State Physics*, Prentice Hall (1957) p. 227. Field emission is a quantum mechanical effect wherein a strong external electric field, on the order of $10^4$ V/cm or greater, alters the potential energy barrier at an emission surface to the extent that electrons are able to tunnel through the potential energy barrier rather than surmount it as in the case of thermionic or photoelectric electron emission. While it is theoretically possible to extract current densities of several million amps/$cm^2$ by field emission, in contrast to other means of electron emission, the actual currents that can be drawn from field emitter materials can be dependent upon the surface and structure of the emitter material.

In order to function efficiently, steady-state field emitter materials require sufficient electrical conduction such that local charges do not build up. It is believed that during steady-state emission in low conductivity field emitter materials, space charge regions can build up around filamentary conduction paths throughout a field emitter material. When this occurs an opposing electric field is built up which requires that a greater applied field be established to maintain electron emission or the emission site will cease emitting electrons. Consequently, as more and more emission sites are "turned off" due to the build up of space charge layers, a higher voltage is required to promote electron emission. On the other hand, as higher voltages are employed, emission sites which were formerly inactive and, thus, lack any limiting space charge region now "turn on". Meanwhile, the space charge regions in the formerly active emission sites slowly neutralize making it possible for these sites to become active again. It is this progressive "turning off" and "turning on" of electron emission sites in filed emitter materials that leads to dynamic changes in electron emission with time.

As set forth hereinabove, numerous solutions to the aforementioned problems of obtaining uniform and invariant electron emission from field emitter materials have been proposed. Included are such things as the use of various homogeneous materials or films that can or can not be coupled with surface adsorbed or deposited layers and/or surface etching. The present invention is directed to a novel solution to these problems.

Figure 1:
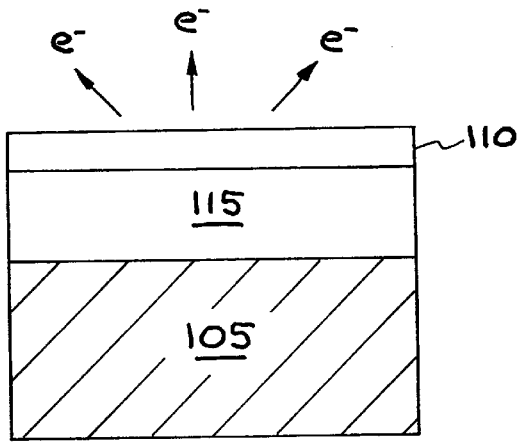
FIG. 1 shows a generic multilayer structure.

What is disclosed herein is a novel field emitter device, comprising an internally structured carbon film, and preferably an a-tC carbon film, that exhibits enhanced steady-state field emission, thereby providing a higher electron current for a given voltage, and improved emission uniformity. Referring now to FIG. 1, the carbon films of the present invention can be disposed on a substrate material 105 which can be a metal, a semiconductor or an insulator and have a structure comprised of at least two layers, and preferably a plurality of layers, of a conductive carbon material (110 & 115), preferably amorphous-tetrahedrally coordinated (a-tC) carbon, wherein alternate layers 110 & 115 possess different resistivities. The preferred structure for the two layer field emitter structure is for top layer 110 to have a resistivity lower than that of bottom layer 115. This particular structure possesses two key benefits; 1) the lower resistivity top layer reduces field non-uniformities at the surface of the field emitter material by allowing charge to dissipate more readily, 2) the higher resistivity layer beneath can act as a ballast resistor.

By providing an internal ballast resistor layer the exponential increase in current with applied voltage observed with most field emitter materials can be attenuated, enabling higher voltages to be employed with the field emitter materials of the present invention, thereby making it possible to turn on more emission sites resulting in greater emission uniformity.

In many applications it is desirable for electron emission to occur at the edge of a field emitter material (FIG. 5). When electron emission occurs at the edge of the field emitter material, it is preferred that the edge structure comprise a plurality of layers of resistive carbon material with adjacent layers having differing resistivities. The lower resistivity layers in this structure provide charge transport parallel to the layers and reduce the possibility of space charge build-up. The edge of the more resistive layer may be a superior emission surface, however. In this case, the emission sites would cluster at the boundaries between lower and higher resistivity layers. The present invention provides the ability to fabricate a multilayer carbon film for a field emitter device with periodicities of a few hundred angstroms or less without using lithographic methods. It can further provide for beneficial electron emission from quantum confined electronic levels at the edge of the material.

Several different approaches can be employed to realize these structured field emitter devices having layers of carbon material with differing resistivities. Both PLD and carbon filtered arc deposition allow tailoring of carbon layer resistivities. Carbon filtered arc deposition employs electrostatic and/or magnetic bending coils and lenses to filter, focus, steer, accelerate/decelerate carbon ions, having differing energy or mass, created when an arc is struck between carbon electrodes. Through selection of carbon ions having appropriate energy/mass, carbon layers having desired resistivities can be produced. Due to the large flux of carbon ions produced by the carbon filtered arc process, rapid deposition of carbon layers can take place over a large area and, hence, can be the preferred method for producing carbon films for flat panel displays.

An alternative approach to producing the structured carbon films of the present invention is the use of PLD. While not matching the deposition rate of carbon filtered arc deposition, PLD can offer additional opportunities for manipulation of the deposition process. Varying the focus of a laser on a graphite target provides the ability to vary the energy density of the laser striking the target thereby varying the resistivity of the carbon layer formed.

Figure 2:
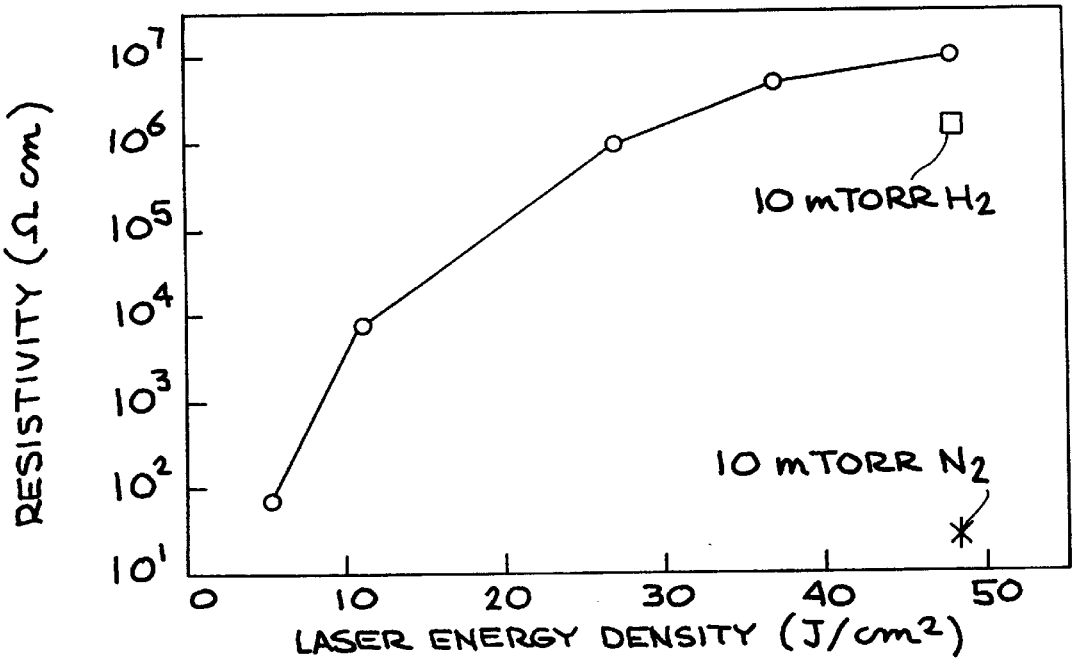
FIG. 2 shows the relationship between laser energy density and resistivity of carbon films.

In one embodiment of the present invention, a carbon film having two layers (bilayer) was deposited onto a metallized (Ti—W) Si substrate using PLD with a KrF (243 nm) excimer laser. The light from a laser was focused onto a rotating graphite target in a vacuum chamber. By changing the focus of the laser the energy density of the KrF laser was varied from 5 J/cm$^2$ to 45 J/cm$^2$. A first layer, having a thickness of about 800 Å, was deposited onto the substrate at a laser fluence of about 45 J/cm$^2$. A second layer, having a thickness of about 200 Å, was deposited onto the first layer at a laser fluence of about 10 J/cm$^2$. As shown in FIG. 4, not only is the electron emission current for a given field superior for the bilayer structure as compared to the single layer structure, but also the emission current increases at a more rapid rate in the case of the bilayer carbon film configuration. Further, as shown in FIG. 2, the resistivities of these two layers varied by 3 orders of magnitude. The deposition described hereinabove can be repeated to yield multilayer (>2 layers) carbon films, wherein each layer has a resistivity that is different from the layer adjacent to it.

Alternative approaches have also been employed by the inventors to modify the resistivities of carbon layers. By way of example, PLD, at a given laser fluence, was used to deposit a layer of carbon, having a resistivity determined by the laser fluence, followed by a second PLD step. The second PLD step took place at the same laser fluence but in an inert or reactive gas atmosphere to form a carbon layer having a lower resistivity. FIG. 2 compares the effect on resistivity of carrying out the step of PLD at a laser fluence of 45 J/cm$^2$ in vacuum to PLD at the same laser fluence but in an atmosphere of about 10 mTorr of $H_2$. A decrease of about an order of magnitude in the resistivity was produced in this way. A much larger decrease in resistivity was obtained in $N_2$.

Other approaches that can be employed to effect changes in the resistivities of carbon films include deposition in inert gas atmospheres, deposition in ion or electron fluxes, deposition while applying heat pulses, deposition while applying a accelerating or decelerating field at the substrate (to accelerate or decelerate the ionized carbon species during deposition). Finally, layers having differing conductivities can be produced by co-depositing other materials, such as boron, and carbon.

Chemical additions to an a-tC layer can modify its resistivity. Incorporation of hydrogen or nitrogen, by depositing a carbon layer in an atmosphere of $H_2$ or $N_2$ or the implantation of H or N into the layer, changes the bonding within the layer, thereby reducing the resistivity of the layer. Incorporation of metals into the carbon layer can also change carbon layer resistivities.

For surface electron emission, bilayer structure with the top layer 110 having a lower resistivity than the bottom layer 115 is the preferred geometry (FIG. 4). Because higher resistivity carbon layers are denser and have a higher fraction of 4-fold carbon bonds, the present invention also contemplates the use of an additional thin, resistive carbon layer on top of a layer of lower resistivity carbon 110 to provide resputtering protection. Various combinations and permutations of the preceding examples, which are intended to be illustrative of the present invention and are not to be construed as limitations or restrictions thereon, will be obvious to those skilled in the art.

Figure 3A:
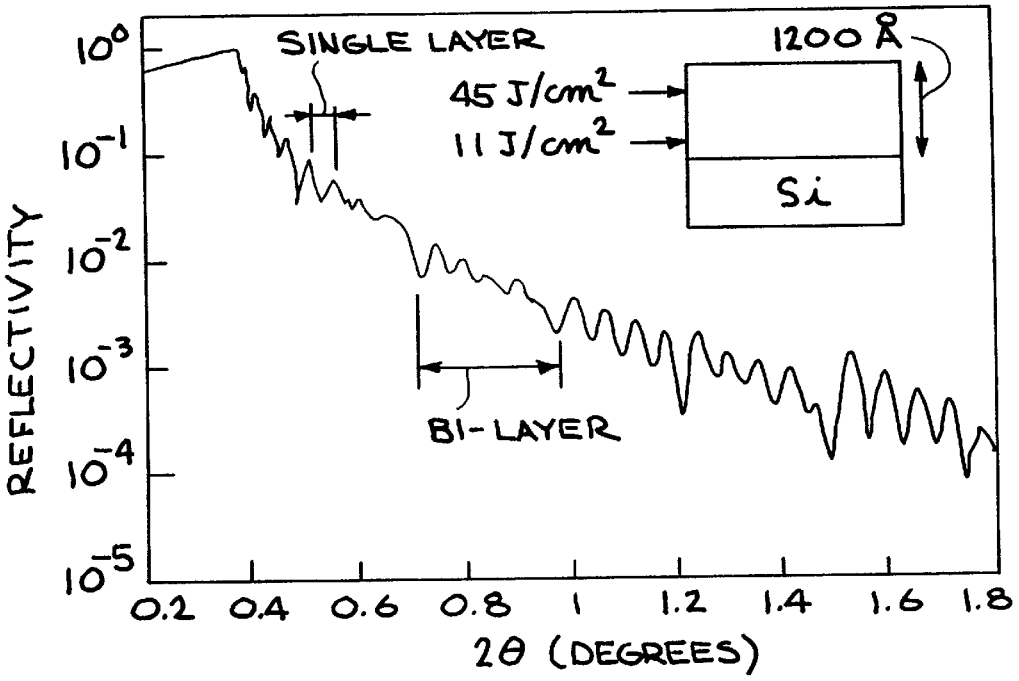
FIGS. 3(*a*) and 3(*b*) show x-ray reflectivity scans of multilayer carbon films.
Figure 3B:
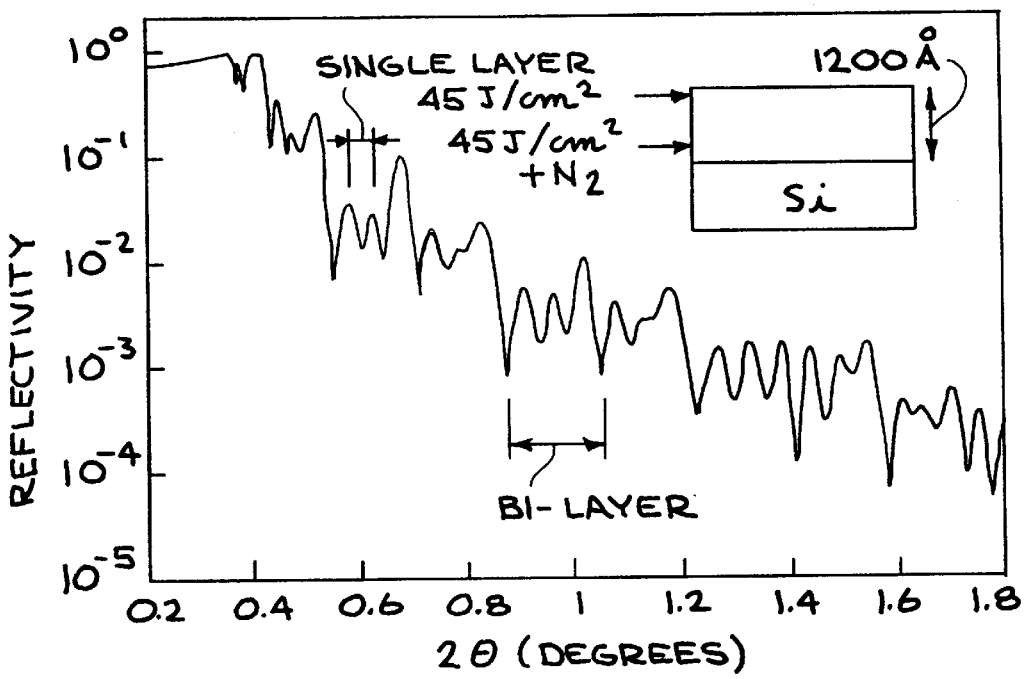

FIG. 3 shows x-ray reflectivity spectra of multi-layer carbon films created by either varying the laser energy density impinging on a graphite target, FIG. 3(*a*), or by selectively doping the carbon layers with nitrogen, FIG. 3(*b*). The oscillations present in the reflectivity spectra result from the interference of two periodicities: the periodicity associated with scattering from single layers (the closely spaced oscillations) and the periodicity associated with scattering from bilayers[either a bilayer consisting of a carbon layer depositied using 45 J/cm$^2$ and a carbon layer using 11 J/cm$^2$ laser fluence in vacuum, FIG. 3(*a*), or the bilayer consisting of a carbon layer deposited using 45 J/cm$^2$ fluence in a background gas of 10 mTorr $N_2$, FIG. 3(*b*)]. The inset shows the geometry of the multilayer and the deposition conditions used in the fabrication of the individual layers.

In addition to enhancement in electron emission, the multilayer carbon films of the present invention also provide for enhanced electron emission uniformity due to the ballast resistor effect, as shown in FIG. 4. The higher resistivity carbon layer provides an internal ballast resistor layer that not only provides uniform contact with the lower resistivity carbon layer deposited thereon, but also functions as a resistor in series with the lower resistivity carbon layer, thereby limiting the current that can flow to discrete emission sites in the lower resistivity layer. In this way, higher voltages can be employed in field emitter devices employing this novel internally structured film thus enabling more emission sites to be turned on resulting in greater emission uniformity.

The present invention permits at least two separate embodiments of the carbon field materials disclosed herein; these are shown in FIG. 5. In the embodiment shown as FIG. 5 (*a*) emission takes place from surface 405 of topmost layer 110. In the embodiment shown as FIG. 4 (*b*) field emission takes place from edge 410 i.e., the emission surface is perpendicular to the direction of the layers in the multilayer stack. In the latter embodiment enhanced electron emission is associated with lateral modulation in the field along the emission surface, improved electronic conduction in the plane of the film, and reduced space charge area. The abrupt changes in the field at the high conductivity-low conductivity boundary can enhance the emission at this boundary, creating a high density of emission sites with good stability and low turn-on field requirements.

The novel structured films of the present invention not only provide an improved material for cold cathode field emission applications but also find application as optical or tribological coatings. Various modifications of the present invention may occur to those skilled in the art without departing from the scope of the invention as defined by the appended claims.

We claim:

1. A field emission device, consisting essentially of:

a substrate; and a carbon film disposed thereon, wherein said carbon film comprises;

a first layer of a carbon material having a resistivity $\rho_1$ disposed on said substrate; and a second layer of a carbon material having a resistivity of $\rho_2$ disposed on said first layer, wherein $\rho_1 \neq \rho_2$.

2. The field emission device of claim 1, wherein $\rho_1 > \rho_2$.

3. The field emission device of claim 1, wherein electron emission is from an edge of said film.

4. The field emission device of claim 1, wherein said carbon film comprises at least three layers of the carbon material, wherein adjacent layers of the carbon material have unequal resistivities.

5. The field emission device of claim 1, wherein the carbon material of said first and second layers comprises amorphous-tetrahedrally coordinated carbon.

6. The field emitter of claim 5, wherein the carbon material includes at least one element selected from the group consisting of nitrogen, hydrogen, inert gases and boron and combinations thereof.

7. The field emission device of claim 1, wherein the carbon material of the first layer of carbon material includes at least one element selected from the group consisting of nitrogen, hydrogen, inert gases and boron and combinations thereof.

8. The field emission device of claim 1, wherein the carbon material of the second layer of carbon material includes at least one element selected from the group consisting of nitrogen, hydrogen, inert gases and boron and combinations thereof.

9. A field emission device made by a method consisting essentially of the following steps:

a) depositing on a substrate a first layer of a carbon material having a resistivity $\rho_1$; and b) depositing on said first layer of carbon material a second layer of a carbon material having resistivity $\rho_2$, wherein $\rho_1 \neq \rho_2$.

10. An internally structured film, comprising layers of a amorphous-tetrahedrally coordinated carbon material, wherein adjacent layers of the carbon material have different resistivities.

11. The film of claim 10, wherein the carbon material includes at least one element selected from the group consisting of nitrogen, hydrogen, inert gases and boron and combinations thereof.

12. A field emission device, including: a film comprising a plurality of layers of amorphous-tetrahedrally coordinated carbon material deposited on a substrate, wherein adjacent layers of the carbon material have unequal resistivities.

13. The field emission device of claim 12, wherein electron emission is from an edge of the film.

14. The field emission device of claim 12, wherein the carbon material includes at least one element selected from the group consisting of nitrogen, hydrogen, inert gases and boron and combinations thereof.

* * * * *